US011786951B2

(12) United States Patent
Ishizaki et al.

(10) Patent No.: US 11,786,951 B2
(45) Date of Patent: Oct. 17, 2023

(54) MANUFACTURING METHOD FOR METAL COMPONENT AND MANUFACTURING APPARATUS FOR METAL COMPONENT

(71) Applicants: ISHIZAKI PRESS INDUSTRIAL CO., LTD., Itami (JP); OSAKA RESEARCH INSTITUTE OF INDUSTRIAL SCIENCE AND TECHNOLOGY, Izumi (JP)

(72) Inventors: Taizo Ishizaki, Itami (JP); Naruaki Shinomiya, Izumi (JP); Nobuhiko Shirakawa, Izumi (JP)

(73) Assignees: ISHIZAKI PRESS INDUSTRIAL CO., LTD., Hyogo (JP); OSAKA RESEARCH INSTITUTE OF INDUSTRIAL SCIENCE AND TECHNOLOGY, Osaka (JP)

( * ) Notice: Subject to any disclaimer, the term of this patent is extended or adjusted under 35 U.S.C. 154(b) by 138 days.

(21) Appl. No.: 16/469,780

(22) PCT Filed: Dec. 28, 2017

(86) PCT No.: PCT/JP2017/047162
§ 371 (c)(1),
(2) Date: Jan. 30, 2020

(87) PCT Pub. No.: WO2018/179657
PCT Pub. Date: Oct. 4, 2018

(65) Prior Publication Data

US 2020/0206796 A1 Jul. 2, 2020

(30) Foreign Application Priority Data

Mar. 27, 2017 (JP) ..... 2017-061398

(51) Int. Cl.
*B21D 22/02* (2006.01)
*B21D 37/16* (2006.01)

(52) U.S. Cl.
CPC ..... *B21D 22/022* (2013.01); *B21D 37/16* (2013.01)

(58) Field of Classification Search
CPC .... B21D 22/022; B21D 22/208; B21D 37/16; C21D 8/0294; C21D 8/0494
(Continued)

(56) References Cited

U.S. PATENT DOCUMENTS 2,073,893 A * 3/1937 Wilkie ..... B21D 28/02 83/685
2,324,205 A * 7/1943 Gladfelter ..... B21D 24/08 72/432

(Continued)

FOREIGN PATENT DOCUMENTS

CN 101209478 A 7/2008
CN 103878237 A 6/2014

(Continued)

OTHER PUBLICATIONS

Chinese Office Action with English translation corresponding to Chinese Application No. 201780075454.7, dated Feb. 3, 2020, 19 pages.

(Continued)

*Primary Examiner* — Katrina M Stransky
*Assistant Examiner* — P Derek Pressley
(74) *Attorney, Agent, or Firm* — Reising Ethington P.C.

(57) ABSTRACT

The manufacturing apparatus for a metal component includes: a preheating portion configured to locally induction-heat a metal plate; and a stamping portion configured to stamp the metal plate. The preheating portion includes a heating coil. The heating coil is arranged such that an axial (Continued)

direction of the heating coil is along a movement direction of the pressing portion and the heating coil faces, in the axial direction, an area where an amount of deformation is relatively large in a processing region of the metal plate to be stamped by the stamping portion. The heating coil is configured such that at least a part of the area where the amount of deformation is relatively large in the processing region of the metal plate is heated to a higher temperature than an area where the amount of deformation is relatively small in the processing region.

7 Claims, 6 Drawing Sheets

(58) Field of Classification Search
USPC ..... 72/342.1, 342.96
See application file for complete search history.

(56) References Cited

U.S. PATENT DOCUMENTS

| | | | | | |
|---|---|---|---|---|---|
| 4,405,386 | A * | 9/1983 | Mravic | B21B 45/004 148/567 |
| 4,532,793 | A | 8/1985 | Bezold | |
| 2006/0277961 | A1* | 12/2006 | Miyahara | B21D 28/02 72/327 |
| 2013/0312478 | A1* | 11/2013 | Kobayashi | B21D 37/16 72/342.6 |
| 2015/0101385 | A1* | 4/2015 | Marti | B21D 13/02 72/333 |
| 2017/0021405 | A1 | 1/2017 | Kabe et al. | |

FOREIGN PATENT DOCUMENTS

| | | | | |
|---|---|---|---|---|
| CN | 106270130 | A * | 1/2017 | |
| FR | 2692504 | A1 * | 12/1993 | B21D 22/208 |
| JP | H05036794 | | 5/1993 | |
| JP | H05036794 | U | 5/1993 | |
| JP | H08120419 | A | 5/1996 | |
| JP | 2007245197 | A | 9/2007 | |
| JP | 2009241140 | A | 10/2009 | |
| JP | 2010253543 | A | 11/2010 | |
| JP | 2011017063 | A * | 1/2011 | |
| JP | 2011111657 | A | 6/2011 | |
| JP | 2011111657 | A * | 6/2011 | |
| JP | 4900909 | B2 | 3/2012 | |
| JP | 2013086097 | A | 5/2013 | |
| JP | 2013212520 | A | 10/2013 | |
| JP | 2014226680 | A | 12/2014 | |
| JP | 2015202501 | A | 11/2015 | |
| JP | 2016107319 | A | 6/2016 | |

OTHER PUBLICATIONS

International Search Report corresponding to International application No. PCT/JP2017/047162, dated Apr. 3, 2018, 2 pages.
Written Opinion corresponding to International application No. PCT/JP2017/047162, dated Apr. 3, 2018, 4 pages.
Japanese Office Action and English translation, corresponding to JP application No. 2017061398, dated Oct. 23, 2018, 11 pages.
German Office Action with English translation corresponding to German Application No. 11 2017 005 649.7, dated Jan. 25, 2023, 17 pages.

* cited by examiner

MANUFACTURING METHOD FOR METAL COMPONENT AND MANUFACTURING APPARATUS FOR METAL COMPONENT

This is a U.S. national stage entry under 35 U.S.C. § 371 of international patent application number PCT/JP2017/047162, filed Dec. 28, 2017, and claims the benefit of Japanese national patent application number 2017-061398, filed Mar. 27, 2017.

TECHNICAL FIELD

The present invention relates to a manufacturing method for a metal component and a manufacturing apparatus for a metal component. Particularly, the present invention relates to a manufacturing method for a metal component and a manufacturing apparatus for a metal component, in which austenitic stainless steel or an aluminum alloy used as a material is stamped.

BACKGROUND ART

Since austenitic stainless steel such as SUS304 has excellent properties such as high strength and high corrosion resistance, there are a wide range of needs in downstream fields as a material that addresses enhancement of the functionality of products.

However, austenitic stainless steel has high tensile strength and high work hardening property. Therefore, when austenitic stainless steel used as a metal material (workpiece) is stamped, shortage of the capability of a stamping machine (shortage of the pressurizing capability and an amount of energy), exacerbation of die abrasion, an increase in the number of steps, and the like occur.

Therefore, when a metal component is manufactured by stamping by using austenitic stainless steel as a metal material, a warm drawing method of stamping the metal material with the metal material heated to have a reduced tensile strength has been applied (refer to, for example, Japanese Patent Laying-Open No. 8-120419).

CITATION LIST

Patent Literature

PTL 1: Japanese Patent Laying-Open No. 8-120419

SUMMARY OF INVENTION

Technical Problem

However, in the conventional warm drawing, heating of the metal material is performed by embedding a cartridge heater in a die which is one of molding dies, heating the die and a blank holder (wrinkle holder) to within a prescribed temperature range (e.g., approximately not lower than 100° C. and not higher than 150° C.), and conveying the heat to the metal material that is in contact with the die. Therefore, in the conventional warm drawing, the die is heated to a temperature equal to or higher than the temperature of the metal material which is a workpiece. However, in order to heat the workpiece to the extent of sufficiently reducing the tensile strength of the workpiece, the long heating time is required from the perspective of a heat capacity of the heater.

This is because the heater used in the conventional warm drawing is embedded in the die as described above, and thus, the heater cannot have a size equal to or larger than a size of the die and the heat capacity of the heater cannot be increased sufficiently.

As a result, it is difficult to shorten the heating time in the conventional warm drawing, and thus, it is difficult to improve the productivity of the metal component. Particularly, austenitic stainless steel has a low thermal conductivity, and thus, it is difficult to shorten the heating time in the conventional warm drawing in which austenitic stainless steel is used as a workpiece, and thus, it is difficult to improve the productivity of the metal component. For example, in the conventional warm drawing in which austenitic stainless steel is used as a workpiece, the productivity is approximately 5 spm (strokes per minute).

The present invention has been made to solve the above-described problem, and a main object of the present invention is to provide a manufacturing method for a metal component and a manufacturing apparatus for a metal component that can achieve improvement of the productivity.

Solution to Problem

A manufacturing method for a metal component according to the present embodiment includes: locally induction-heating a metal plate by a heating coil; and stamping the metal plate by using a die and a pressing portion configured to press the metal plate against the die, after the induction-heating the metal plate. In the induction-heating the metal plate, at least a part of an area where an amount of deformation is relatively large in a processing region of the metal plate to be stamped in the stamping the metal plate is heated to a higher temperature than an area where the amount of deformation is relatively small in the processing region.

In the above-described manufacturing method for a metal component, the stamping is preferably drawing. In the induction-heating the metal plate, at least a part of an outer area located outside a contact area is heated to a higher temperature than the contact area, the contact area being an area coming into contact with a shoulder of the pressing portion in the processing region of the metal plate to be stamped in the stamping the metal plate.

In the above-described manufacturing method for a metal component, in the induction-heating the metal plate, the metal plate is induction-heated such that the temperature of at least a part of the outer area of the metal plate becomes gradually higher from a side close to the contact area toward a side distant from the contact area.

A manufacturing apparatus for a metal component according to the present embodiment includes: a preheating portion configured to locally induction-heat a metal plate; and a stamping portion configured to stamp the metal plate. The preheating portion includes a heating coil. The stamping portion includes a die and a pressing portion configured to press the metal plate against the die. The heating coil is arranged such that an axial direction of the heating coil is along a movement direction of the pressing portion and the heating coil faces, in the axial direction, an area where an amount of deformation is relatively large in a processing region of the metal plate to be stamped by the stamping portion. The heating coil is configured such that at least a part of the area where the amount of deformation is relatively large in the processing region of the metal plate is heated to a higher temperature than an area where the amount of deformation is relatively small in the processing region.

In the above-described manufacturing apparatus for a metal component, the stamping is preferably drawing. The heating coil is arranged not to face a contact area in the axial direction, but to face, in the axial direction, at least a part of an outer area located outside the contact area, the contact area being an area coming into contact with a shoulder of the pressing portion in the processing region.

In the above-described manufacturing apparatus for a metal component, the heating coil has a first coil, and a second coil connected to the first coil and arranged at a position closer to the metal plate than the first coil in the axial direction. An inner diameter of the first coil is shorter than an inner diameter of the second coil.

Advantageous Effects of Invention

According to the present invention, there can be provided a manufacturing method for a metal component and a manufacturing apparatus for a metal component that can achieve improvement of the productivity.

DESCRIPTION OF EMBODIMENTS

Figure 1:
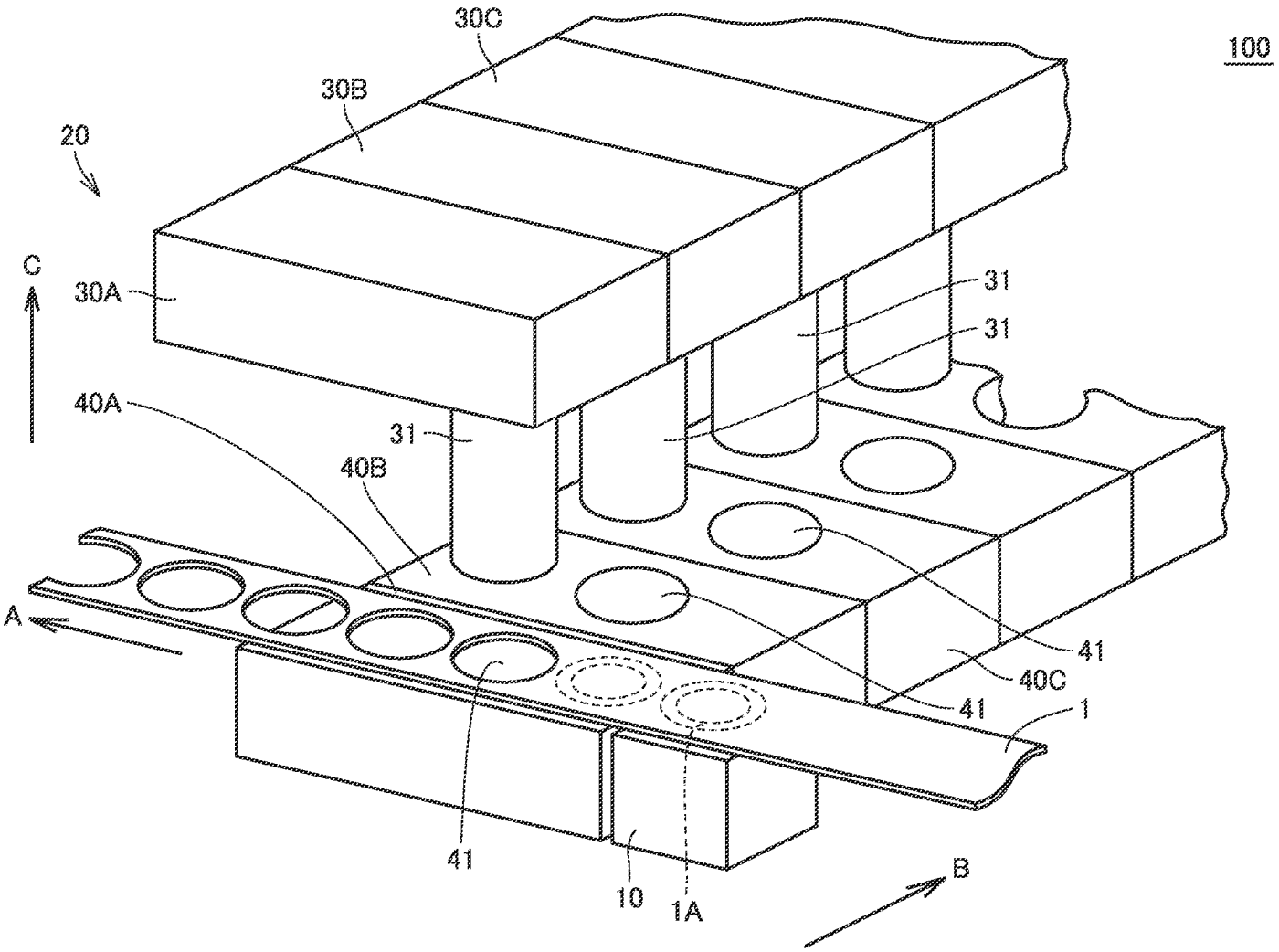
FIG. 1 illustrates a manufacturing apparatus for a metal component according to the present embodiment.

An embodiment of the present invention will be described hereinafter with reference to the drawings, in which the same or corresponding portions are denoted by the same reference numerals and description thereof will not be repeated.

<Configuration of Manufacturing Apparatus for Metal Component>

A manufacturing apparatus 100 for a metal component according to the present embodiment will be described with reference to FIGS. 1 to 3. Manufacturing apparatus 100 for the metal component according to the present embodiment includes a preheating portion 10 configured to locally induction-heat a metal plate 1 which is a material to be processed (workpiece), and a stamping portion 20 configured to stamp (shear and draw) metal plate 1.

A material for metal plate 1 is austenitic stainless steel, and is, for example, SUS304, SUS316L or the like. Metal plate 1 has, for example, a rolling direction A and a width direction B, and is conveyed along rolling direction A in manufacturing apparatus 100 for the metal component.

Preheating portion 10 is arranged on the more upstream side than stamping portion 20 on a conveyance path for metal plate 1. That is, in manufacturing apparatus 100 for the metal component, metal plate 1 reaches stamping portion 20 via preheating portion 10. Preferably, preheating portion 10 and stamping portion 20 are continuously arranged on the conveyance path for metal plate 1. That is, preheating portion 10 and stamping portion 20 are provided such that heated metal plate 1 sent out via preheating portion 10 can be conveyed to stamping portion 20 and sheared and drawn without interruption.

Preheating portion 10 can locally heat metal plate 1. Preheating portion 10 can locally heat metal plate 1 by, for example, high-frequency induction-heating. Preheating portion 10 includes a heating coil 11 (see FIG. 2). Opposing ends of heating coil 11 are connected to a not-shown alternating current (AC) power source.

Figure 3:
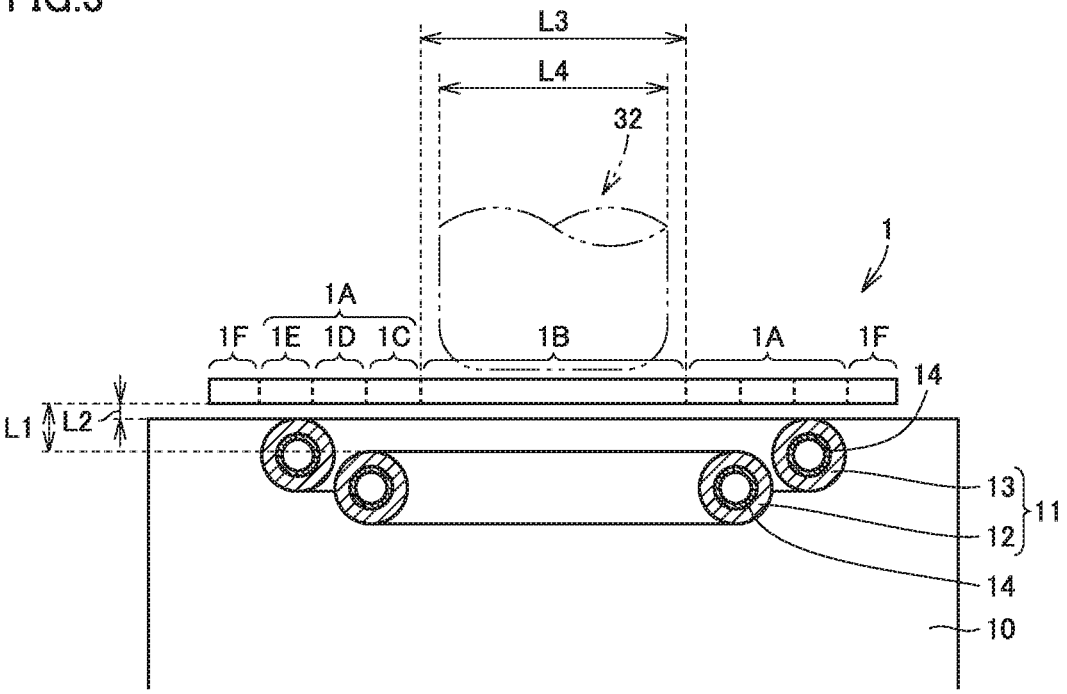
FIG. 3 is a cross-sectional view taken along line in FIG. 2.

As shown in FIG. 3, heating coil 11 is arranged such that an axial direction C of heating coil 11 is along a below-described movement direction of a pressing portion 32 of stamping portion 20. In FIG. 3, pressing portion 32 is indicated by an imaginary line. Heating coil 11 is arranged to face, in above-described axial direction C, only an area (outer area 1A) where an amount of deformation is relatively large in a processing region 1A, 1B of metal plate 1 to be stamped by the stamping portion. Heating coil 11 is arranged closer to the area where the amount of deformation is relatively large in processing region 1A, 1B, than an area (inner area 1B) where the amount of deformation is relatively small in processing region 1A, 1B.

When such heating coil 11 is supplied with an AC current from the AC power source, heating coil 11 can locally induction-heat metal plate 1. Heating coil 11 supplied with the AC current generates an alternating magnetic flux penetrating through metal plate 1, and generates an induction current in metal plate 1 in a direction that cancels out the alternating magnetic flux. Metal plate 1 is heated by Joule heat generated by the induction current. An amount of the induction current generated in metal plate 1 is larger in a region where a density of the alternating magnetic flux penetrating through metal plate 1 is higher. The density of the alternating magnetic flux penetrating through metal plate 1 is higher in a region closer to heating coil 11. Thus, an amount of Joule heat generated in a portion of processing region 1A, 1B arranged relatively close to heating coil 11 is larger than an amount of Joule heat generated in a portion of processing region 1A, 1B arranged relatively distant from heating coil 11. As a result, heating coil 11 can locally induction-heat the area of processing region 1A, 1B of metal plate 1 arranged relatively close to heating coil 11 and having the relatively large amount of deformation in stamping.

Processing region 1A, 1B is a region included in a blank formed by shearing in stamping portion 20. Processing region 1A, 1B includes outer area 1A located outside a contact area coming into contact with a shoulder of pressing portion 32 (a corner of pressing portion 32 at which a surface extending along the movement direction of pressing portion 32 is connected to a surface extending along a direction intersecting with the movement direction) of stamping portion 20 in processing region 1A, 1B, and inner area 1B having the contact area and located inside outer area 1A. As described above, when metal plate 1 is heated by preheating portion 10, outer area 1A is arranged at a position closer to heating coil 11 than inner area 1B. Outer area 1A is an area of processing region 1A, 1B where a deformation resistance $\sigma$ during first drawing by stamping portion 20 is relatively higher than that of inner area 1B. Deformation resistance $\sigma$ is expressed by $c\varepsilon^n$, using a plasticity coefficient c, a distortion $\varepsilon$ and a work hardening exponent n.

Figure 4:
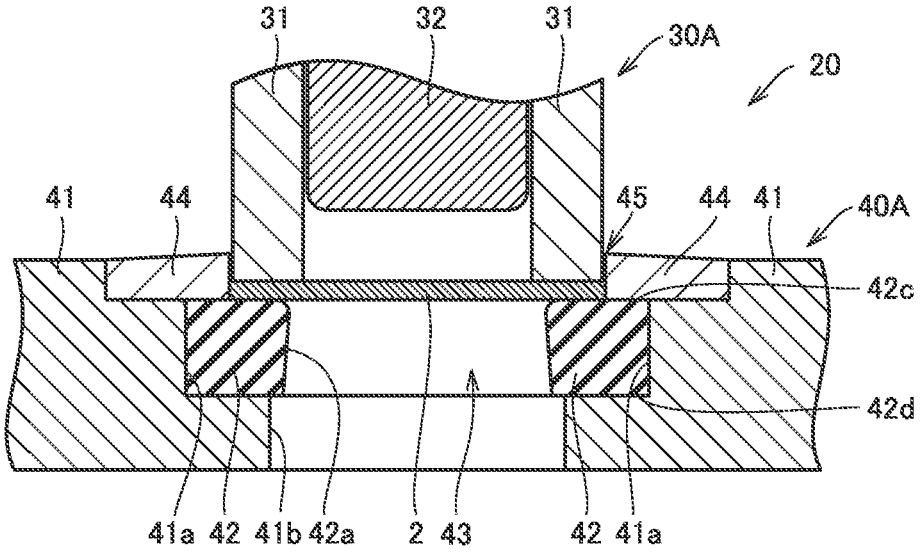
FIG. 4 is a partial cross-sectional view showing a stamping portion of the manufacturing apparatus for the metal component according to the present embodiment.

When a molded object obtained by first drawing by stamping portion 20 is formed of, for example, a bottom portion and a sidewall portion, outer area 1A includes an area that forms the sidewall portion in metal plate 1. When a molded object obtained by first drawing by stamping portion 20 is formed of, for example, a bottom portion, a sidewall portion and a flange portion, outer area 1A includes areas that form the sidewall portion and the flange portion in metal plate 1. Inner area 1B includes areas coming into contact with a tip portion of pressing portion 32 and the shoulder of pressing portion 32. The relatively stronger force is applied in above-described axial direction C to the area of inner area 1B coming into contact with the shoulder of pressing portion 32 than outer area 1A. Inner area 1B includes, for example, an area that forms the bottom portion of the molded object obtained by first drawing by stamping portion 20. As shown in FIGS. 3 and 4, a width L3 of inner area 1B is equal to or greater than a width L4 of pressing portion 32 in width direction B. Width L3 is, for example, 50.5 mm and width L4 is, for example, 38.5 mm. A length of inner area 1B in rolling direction A is, for example, 62 mm and a length of pressing portion 32 in rolling direction A is, for example, 50 mm.

Figure 2:
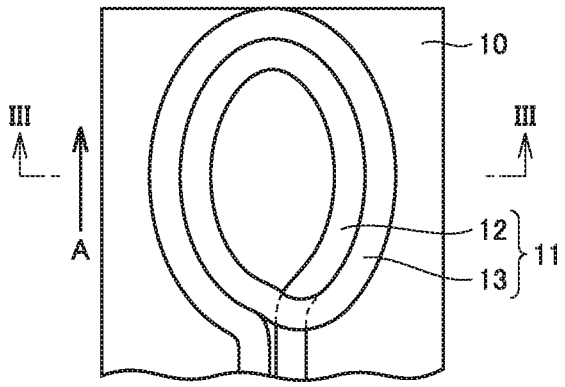
FIG. 2 is a plan view showing a heating coil in a preheating portion of the manufacturing apparatus for the metal component according to the present embodiment.

As shown in FIGS. 2 and 3, heating coil 11 has a first coil 12 and a second coil 13. Axial direction C of first coil 12 is along axial direction C of second coil 13. A planar shape of each of first coil 12 and second coil 13 when viewed from axial direction C is, for example, substantially circular or substantially elliptical. Second coil 13 is serially connected to first coil 12. First coil 12 and second coil 13 are arranged in substantially parallel with metal plate 1. From a different perspective, first coil 12 and second coil 13 extend along a direction intersecting with axial direction C. First coil 12 is a portion of heating coil 11 wound such that the shortest distance to metal plate 1 in above-described axial direction C is substantially equal to a distance L1 (see FIG. 3). Second coil 13 is a portion of heating coil 11 wound such that the shortest distance to metal plate 1 in above-described axial direction C is substantially equal to a distance L2 (see FIG. 3) different from distance L1.

As shown in FIG. 3, second coil 13 is arranged at a position closer to metal plate 1 than first coil 12 in above-described axial direction C. Shortest distance L1 between first coil 12 and metal plate 1 in above-described axial direction C is longer than shortest distance L2 between second coil 13 and metal plate 1 in above-described axial direction C. First coil 12 is arranged to face, in above-described axial direction C, a region of outer area 1A located inside. Second coil 13 is arranged to face, in above-described axial direction C, a region of outer area 1A located outside. An inner diameter of first coil 12 is shorter than an inner diameter of second coil 13. When viewed from above-described axial direction C, first coil 12 is arranged inside second coil 13.

As shown in FIG. 3, above-described heating coil 11 can form a first heated area 1C heated to the lowest temperature in outer area 1A, a second heated area 1D located outside first heated area 1C and heated to a higher temperature than first heated area 1C, and a third heated area 1E located outside second heated area 1D and heated to the highest temperature. First heated area 1C is located on the innermost side in outer area 1A and is adjacent to inner area 1B. Third heated area 1E is located on the outermost side in outer area 1A. Second heated area 1D is located outside first heated area 1C and is located inside third heated area 1E.

Preheating portion 10 is provided to be capable of heating metal plate 1 to, for example, a temperature of not lower than 50° C. and not higher than 200° C. The temperature of heating of metal plate 1 by preheating portion 10 is, for example, a temperature that allows a tensile strength of outer area 1A to be sufficiently reduced during first drawing. Since preheating portion 10 includes heating coil 11 having first coil 12 and second coil 13, preheating portion 10 can heat metal plate 1 such that a temperature difference between first heated area 1C and third heated area 1E is, for example, approximately 50° C. Preheating portion 10 can, for example, heat first heated area 1C to the temperature of approximately 50° C., while heating third heated area 1E to the temperature of approximately 100° C.

As shown in FIG. 3, heating coil 11 has therein pipes 14 through which the cooling water flows, for example. Pipe 14 in first coil 12 is serially connected to pipe 14 in second coil 13.

Figure 6:
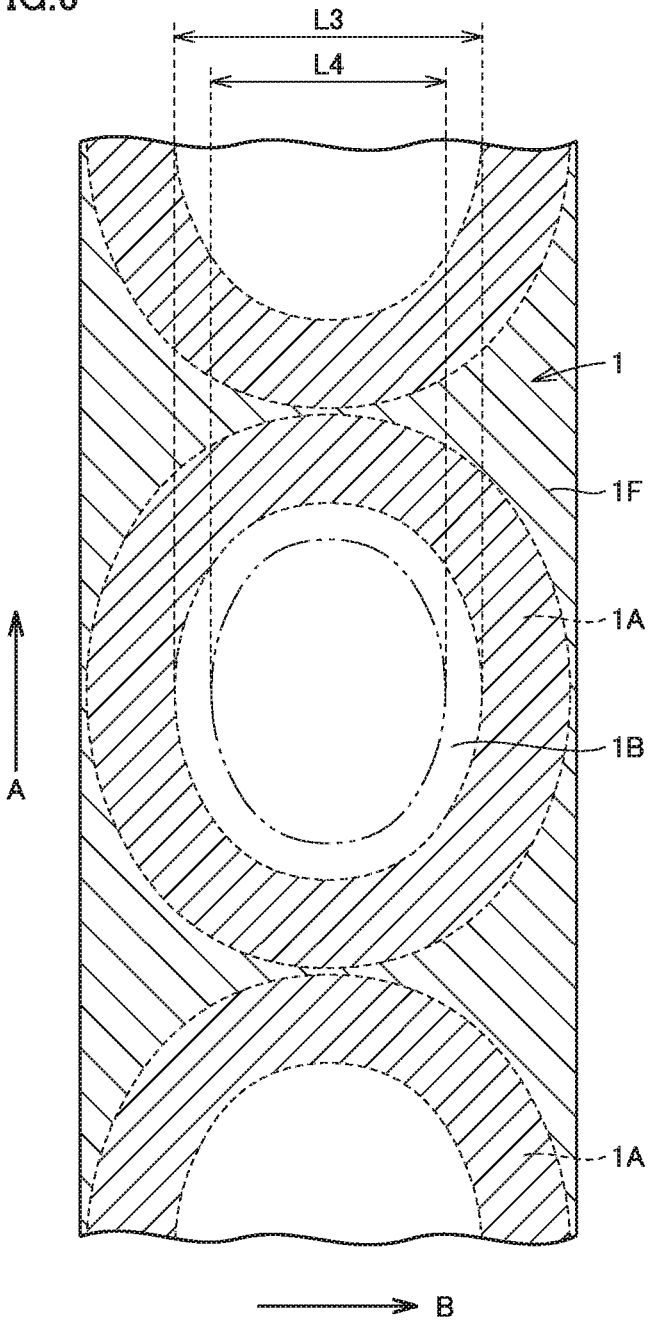
FIG. 6 is a plan view showing a heated area of a metal plate induction-heated by the heating coil shown in FIGS. 2 and 3.

As shown in FIGS. 3 and 6, metal plate 1 has, for example, a non-processing region 1F on the outer side of processing region 1A, 1B. Non-processing region 1F is adjacent to third heated area 1E. When metal plate 1 is heated by preheating portion 10, non-processing region 1F is arranged at a position closer to heating coil 11 than inner area 1B. Non-processing region 1F is, for example, a region that is not punched during blanking before first drawing.

Stamping portion 20 is configured as, for example, a so-called transfer press. Stamping portion 20 includes, for example, a plurality of punch assemblies (e.g., at least three punch assemblies 30A, 30B and 30C) arranged above metal plate 1 in a vertical direction, and a plurality of die assemblies (e.g., at least three die assemblies 40A, 40B and 40C) arranged below metal plate 1 in the vertical direction. As shown in FIG. 1, the plurality of punch assemblies are arranged side by side along width direction B of metal plate 1. As shown in FIG. 1, the plurality of die assemblies are arranged side by side along width direction B of metal plate 1.

Figure 5:
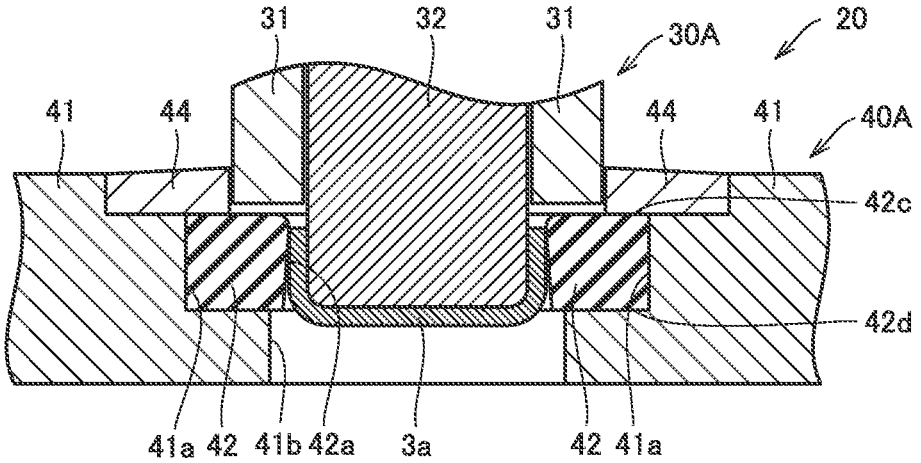
FIG. 5 is a partial cross-sectional view showing the stamping portion of the manufacturing apparatus for the metal component according to the present embodiment.

As shown in FIGS. 4 and 5, punch assembly 30A has a holder 31 and pressing portion 32. Die assembly 40A includes a base portion 41, a die 42 and a guide portion 44.

Holder 31 is provided to be capable of shearing metal plate 1 as a coil material conveyed to a prescribed position on die 42, a through hole 43 and guide portion 44. In other words, holder 31 is provided as a punch for shearing. That is, holder 31 is provided such that an end of holder 31 located in a lower part in the vertical direction can come into contact with metal plate 1 arranged on die 42. Holder 31 is provided such that at least a part of holder 31 overlaps with die 42 provided in die assembly 40 in the vertical direction. Holder 31 can press a metal plate 2 (see FIG. 4) as a blank formed by shearing against die 42 from above in the vertical direction. Holder 31 is, for example, cylindrically provided, and an axial direction thereof extends along the vertical direction. A material for holder 31 is, for example, cemented carbide (hereinafter, simply referred to as "carbide") or alloy tool steel such as SKD11, and is preferably carbide or a material having a thermal conductivity (e.g., approximately 14.0 W/m·K) lower than that of, for example, JIS standard SKD11 (hereinafter, simply referred to as SKD11), and is cermet, for example.

Pressing portion 32 is provided to be capable of drawing metal plate 2 as a blank arranged at a prescribed position on die 42 and through hole 43 and in a through hole 45 of guide portion 44. In other words, pressing portion 32 is provided as a punch for drawing. Pressing portion 32 is provided to be movable in the vertical direction relative to holder 31 in a hollow portion of cylindrically provided holder 31. That is, pressing portion 32 is surrounded by holder 31. In addition, pressing portion 32 is provided such that an end of pressing portion 32 located on the lower side in the vertical direction can protrude downwardly in the vertical direction from the end of holder 31 located on the lower side in the vertical direction. Preferably, a not-shown cooling portion configured to cool pressing portion 32 is provided in pressing portion 32. The cooling portion in pressing portion 32 is, for example, provided to allow the cooling water to circulate therethrough and to allow the heat received from pressing portion 32 to be dissipated to the outside of pressing portion 32.

Base portion 41 is configured as a support of die 42 in die assembly 40.

Base portion 41 is provided with a groove 41*a* that can hold die 42 therein. Groove 41*a* has, for example, end surfaces extending in the vertical direction and in the horizontal direction, and groove 41*a* is formed such that these end surfaces can come into surface contact with an outer circumferential end surface and a bottom surface of die 42. Furthermore, on the lower side in the vertical direction with respect to groove 41*a*, base portion 41 is provided with a groove 41*b* continuous to groove 41*a*.

Die 42 has an upper end surface 42*c* located in an upper part in the vertical direction, and die 42 is provided, for example, such that upper end surface 42*c* can come into surface contact with outer area 1A of metal plate 2 as a blank. Die 42 has therein through hole 43 for restricting a contour of a molded object 3*a* obtained by drawing metal plate 2 as a blank. Through hole 43 is arranged to overlap with inner area 1B of metal plate 1, 2 in the vertical direction. Preferably, a material for die 42 has a thermal conductivity lower than that of carbide, SKD11 or the like that is a material for a die of a conventional warm stamping apparatus. Preferably, the material for die 42 has a thermal conductivity lower than that of a material for base portion 41. With such a configuration, the heat generated in metal plate 2 by processing heat generation during stamping is less likely to be dissipated to base portion 41, guide portion 44 and the like through die 42, and is stored in metal plate 2 and can effectively contribute to increasing temperature and prevention of cooling (heat retention) of metal plate 2. Therefore, stamping portion 20 including such die 42 has high drawing moldability. Particularly, in stamping portion 20 configured as a transfer press, the dies in die assemblies 40B and 40C are also configured as described above, and thus, the high drawing moldability using processing heat generation is also achieved after second drawing.

Preferably, the material for die 42 is, for example, a material including at least one of cermet mainly composed of titanium carbonitride (TiCN) or titanium carbide (TiC), and zirconium oxide ($ZrO_2$). $ZrO_2$, TiCN-based cermet and TiC-based cermet are further lower in thermal conductivity than the lower-in-thermal-conductivity one of carbide and SKD11. Specifically, the thermal conductivity of carbide at ordinary temperature that is commonly used as a conventional material for a die is 71 W/(m·K), whereas the thermal conductivity of TiCN-based cermet at ordinary temperature is 14 W/(m·K) and the thermal conductivity of $ZiO_2$ at ordinary temperature is 3 W/(m·K). That is, the thermal conductivity of cermet is approximately one-fifth of the thermal conductivity of carbide. From a different perspective, the thermal conductivity of the material for die 42 at ordinary temperature is, for example, less than 27.2 W/m·K.

An inner circumferential end surface 42*a* of through hole 43 may be formed along a direction intersecting with the vertical direction. In this case, inner circumferential end surface 42*a* of through hole 43 may have an inclination angle that forms an acute angle with respect to upper end surface 42*c* coming into contact with metal plate 2 in die 42, and may have an inclination angle that forms an obtuse angle with respect to a lower end surface 42*d*.

Through hole 45 is formed in guide portion 44. A hole diameter of through hole 45 is larger than a hole diameter of through hole 43 and is larger than an outer diameter of holder 31. Guide portion 44 is provided to be capable of shearing metal plate 1 (see FIG. 1) as a coil material together with holder 31, and is provided to be capable of guiding metal plate 2 (see FIG. 4) as a blank formed by shearing to the prescribed position on die 42. In other words, guide portion 44 is provided as a die for shearing. Guide portion 44 may also be provided to be capable of sandwiching die 42 between guide portion 44 and base portion 41. A material for guide portion 44 is, for example, carbide or alloy tool steel such as SKD11.

The plurality of punch assemblies and the plurality of die assemblies are configured basically similarly to punch assembly 30A and die assembly 40A described above, respectively. However, the plurality of punch assemblies and the plurality of die assemblies are different from one another in, for example, the shape of pressing portion 32 and die 42.

The stamping portion further includes a not-shown conveying portion configured to convey the molded object molded by each of the plurality of punch assemblies and the plurality of die assemblies to another punch assembly and die assembly that are adjacent in above-described width direction B. For example, by punch assembly 30A and die assembly 40A, metal plate 1 preheated by preheating portion 10 is subjected to punching to thereby form metal plate 2, which is then subjected to first drawing. At the same time, a molded object previously subjected to first drawing by punch assembly 30A and die assembly 40A is subjected to second drawing by punch assembly 30B and die assembly 40B. At the same time, a molded object previously subjected to second drawing by punch assembly 30B and die assembly 40B is subjected to third drawing by punch assembly 30C and die assembly 40C. Next, the molded object obtained by first drawing is conveyed from a region between punch assembly 30A and die assembly 40A to a region between punch assembly 30B and die assembly 40B along above-described width direction B. At the same time, the molded object obtained by second drawing is conveyed from the region between punch assembly 30B and die assembly 40B to a region between punch assembly 30C and die assembly 40C along above-described width direction B. At the same time, the molded object obtained by third drawing is taken out from the region between punch assembly 30C and die assembly 40C along above-described width direction B.

<Manufacturing Method for Metal Component>

Figure 7:
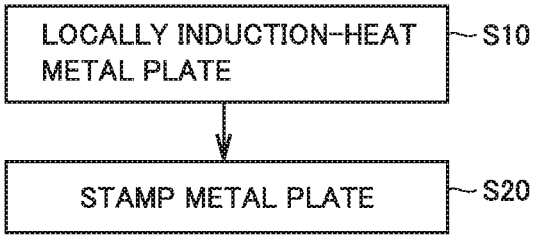
FIG. 7 is a flowchart of a manufacturing method for the metal component according to the present embodiment.

As shown in FIG. 7, a manufacturing method for a metal component according to the present embodiment includes the steps of: locally induction-heating metal plate 1 (S10); and stamping metal plate 1 (S20).

In the step of induction-heating metal plate 1 (S10), metal plate 1 is first conveyed to preheating portion 10 and is arranged such that outer area 1A of metal plate 1 faces heating coil 11 in above-described axial direction C. The material for metal plate 1 is, for example, austenitic stainless steel. Next, the AC current is supplied to heating coil 11, and thus, outer area 1A of metal plate 1 is heated to a higher temperature than inner area 1B. That is, at least a part of the area (outer area 1A) where the amount of deformation is relatively large in processing region 1A, 1B (see FIG. 3) of metal plate 1 to be stamped in the step of stamping metal plate 1 (S20) is heated to a higher temperature than the area (inner area 1B) where the amount of deformation is relatively small in processing region 1A, 1B. Outer area 1A is heated to, for example, a temperature of not lower than 50° C. and not higher than 150° C. The heating time (current-applying time) in this step (S10) can be set at one second when the heating temperature is, for example, approximately 200° C. That is, the heating time in this step (S10) can be significantly shortened, as compared with the case of performing preheating using the cartridge heater embedded in the die. In this step (S10), one processing region 1A of metal plate 1 to be stamped in the step of stamping metal plate 1 (S20) can be heated for, for example, one second.

In this step (S10), using heating coil 11 including first coil 12 and second coil 13, metal plate 1 is heated such that the temperature of outer area 1A of metal plate 1 becomes gradually higher from the side close to the above-described contact area toward the side distant from the above-described contact area.

Next, metal plate 1 is stamped. The step of stamping metal plate 1 (S20) is continuously performed without interruption between the previous step (S10) and the step of stamping metal plate 1 (S20). Specifically, metal plate 1 heated to the prescribed temperature in preheating portion 10 in the previous step (S10) and discharged from preheating portion 10 is quickly conveyed to stamping portion 20 and arranged between punch assembly 30A and die assembly 40A.

As shown in FIG. 4, using holder 31 including a blanking punch and guide portion 44 including a blanking die, metal plate 2 as a blank is first punched from coil-like metal plate 1. Metal plate 2 is pushed into through hole 45 of guide portion 44 by holder 31, and is guided by guide portion 44 and arranged on die 42.

Figure 8:
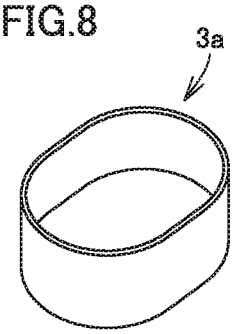
FIG. 8 is a perspective view showing a molded object after first drawing in the manufacturing method for the metal component according to the present embodiment.

Metal plate 2 arranged on die 42 is sandwiched between holder 31 and die 42. Thereafter, as shown in FIG. 5, pressing portion 32 is moved downwardly in the vertical direction relative to holder 31 such that the lower end of pressing portion 32 reaches groove 41*b*. As a result, metal plate 2 is molded into molded object 3*a* shown in, for example, FIG. 8.

In this step (S20), the temperature of metal plates 1 and 2 is set within a temperature range (e.g., not lower than 50° C. and not higher than 150° C. when the material for metal plate 1 is SUS304) in which the tensile strength can be sufficiently reduced during stamping and a reduction in moldability caused by a decline in function of the processing oil by heating is suppressed. Preferably, the lower limit temperature of metal plate 1 is set at a temperature (e.g., not lower than 90° C. when the material for metal plate 1 is SUS304) that does not cause martensitic transformation immediately after stamping. The temperature of metal plate 1 before stamping may be equal to or lower than the lower limit temperature. In addition, the other conditions for stamping (such as the punch speed) can be set to be approximately equal to those of conventional stamping. In this step (S20), the processing time required for blanking and the processing time required for each drawing of multi-stage drawing can be set at, for example, one second. In addition, in this step (S20), the cooling water is preferably circulated through the above-described cooling portion of pressing portion 32.

Figure 9:
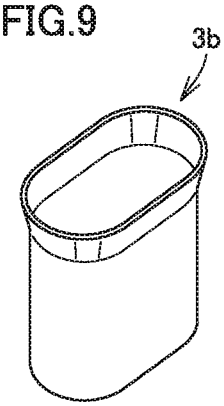
FIG. 9 is a perspective view showing a molded object after second drawing in the manufacturing method for the metal component according to the present embodiment.
Figure 10:
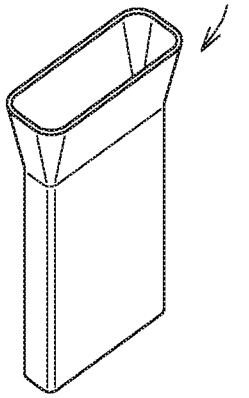
FIG. 10 is a perspective view showing a molded object after final drawing in the manufacturing method for the metal component according to the present embodiment.
Figure 11:
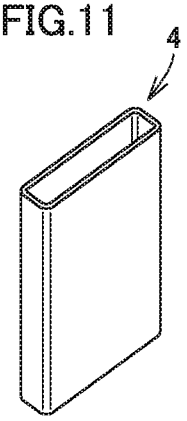
FIG. 11 is a perspective view showing the metal component manufactured by the manufacturing method for the metal component according to the present embodiment.

In this step (S20), multi-stage drawing is performed using stamping portion 20 configured as a transfer press. In multi-stage drawing, deep drawing may be performed. For example, metal plate 2 is molded into molded object 3*a* shown in FIG. 8 by first drawing. Molded object 3*a* is molded into a molded object 3*b* shown in FIG. 9 by second drawing. Molded object 3*b* is molded into a molded object 3*c* shown in FIG. 10 by third drawing. Thereafter, molded object 3*c* is subjected to drawing the arbitrary number of times, for example, and to finishing such as trimming, to be thereby molded into a metal component 4 shown in FIG. 11. Stamping portion 20 can continuously manufacture metal component 4 by continuously and repeatedly performing conveyance of metal plates 1 and 2, molded objects 3*a*, 3*b* and 3*c*, and metal component 4, the above-described step (S10) and this step (S20). In this step (S20), blanking and first drawing may be performed by different punch assemblies and die assemblies.

<Function and Effect>

The manufacturing method for the metal component according to the present embodiment includes the steps of: locally induction-heating metal plate 1 by heating coil 11 (S10); and stamping metal plate 2 by using die 42 and pressing portion 32 configured to press metal plate 2 against die 42 (S20), after the step of induction-heating metal plate 1 (S10). In the step of induction-heating metal plate 1 (S10), the area (outer area 1A) where the amount of deformation is relatively large in processing region 1A, 1B of metal plate 1 to be stamped in the step of stamping metal plate 2 (S20) is heated to a higher temperature than the area (inner area 1B) where the amount of deformation is relatively small in processing region 1A, 1B.

With such a configuration, as compared with the conventional warm drawing method in which the metal plate is preheated through the die by the heater embedded in the die, metal plate 1 can be locally heated in a shorter time in the step of induction-heating metal plate 1 (S10), such that the deformation resistance of outer area 1A can be sufficiently reduced and a reduction in tensile strength of inner area 1B can be suppressed. Therefore, the time required for manufacturing of one metal component in the manufacturing method for the metal component according to the present embodiment is not limited by the preheating time as in the above-described conventional warm drawing method, and thus, is shortened as compared with the time in the conventional warm drawing method. As a result, the productivity of the manufacturing method for the metal component according to the present embodiment is higher than that of the conventional warm drawing method. For example, in the manufacturing method for the metal component according to the present embodiment, the heating time in the step of induction-heating metal plate 1 (S10) can be set at one second. Therefore, in the manufacturing method for the metal component according to the present embodiment, the number of metal components manufactured per one minute can be set at 60 (in other words, 60 spm).

Particularly, the material for metal plate 1 is austenitic stainless steel and has a high tensile strength. On the other hand, the tensile strength of austenitic stainless steel is significantly reduced when heated within the temperature range of not lower than 0° C. and not higher than 100° C. A rate of reduction in tensile strength of austenitic stainless steel caused by an increase in temperature from 0° C. to 100° C. is approximately 35% in the case of, for example, SUS304. Therefore, by locally induction-heating outer area 1A of metal plate 1 to a temperature of not lower than 50° C. and not higher than 150° C. in the step of induction-heating metal plate 1 (S10), the deformation resistance of outer area 1A to stamping can be quickly and sufficiently reduced. In the manufacturing method for the metal component according to the present embodiment, even when the material for metal plate 1 is austenitic stainless steel, the number of metal components manufactured per one minute can be not less than 60 (in other words, not less than 60 spm).

Furthermore, inner area 1B is not heated like outer area 1A in the step of induction-heating metal plate 1 (S10). Therefore, a reduction in tensile strength of inner area 1B is suppressed, as compared with the case of heating processing region 1A, 1B as a whole by, for example, current-applying heating or furnace heating. As described above, inner area 1B has the contact area coming into contact with the shoulder of pressing portion 32 in the step of stamping metal plate 2 (S20). That is, a reduction in tensile strength of the contact area is suppressed in the step of induction-heating metal plate 1 (S10), and thus, a break of the contact area is suppressed in the step of stamping metal plate 2 (S20). Therefore, even when deep drawing is, for example, performed in the step of stamping metal plate 2 (S20), a break of the above-described contact area is suppressed.

In the above-described manufacturing method for the metal component, stamping is drawing. In the step of induction-heating metal plate 1 (S10), at least a part of outer area 1A located outside the contact area is locally heated, the contact area being an area coming into contact with the shoulder of pressing portion 32 in processing region 1A, 1B of metal plate 1 to be stamped in the step of stamping metal plate 2 (S20). As a result, at least a part of outer area 1A has a temperature higher than that of the contact area.

Therefore, as described above, a break of the above-described contact area of processing region 1A, 1B is suppressed in the step of stamping metal plate 2 (S20). Furthermore, when pressing portion 32 is provided with the cooling portion, a break of the above-described contact area can be suppressed more effectively in the step of stamping metal plate 2 (S20). This is because the above-described contact area of processing region 1A, 1B can be cooled to a temperature equal to or lower than the ordinary temperature by coming into contact with pressing portion 32, and thus, a reduction in tensile strength of the above-described contact area can be suppressed more effectively.

In the above-described manufacturing method for the metal component, in the step of induction-heating metal plate 1 (S10), metal plate 1 is induction-heated such that the temperature of outer area 1A of metal plate 1 becomes gradually higher from the side close to the above-described contact area toward the side distant from the above-described contact area.

With such a configuration, it is possible to heat outer area 1A to a high temperature that allows sufficient reduction in deformation resistance of outer area 1A, while suppressing an increase in temperature of inner area 1B.

Manufacturing apparatus 100 for the metal component according to the present embodiment includes preheating portion 10 configured to locally induction-heat metal plate 1, and stamping portion 20 configured to stamp metal plate 1. Preheating portion 10 includes heating coil 11. Stamping portion 20 includes die 42, and pressing portion 32 configured to press metal plate 2 against die 42. Heating coil 11 is arranged such that axial direction C of heating coil 11 is along the movement direction of pressing portion 32 and heating coil 11 faces, in the axial direction, only outer area 1A that is the area where the amount of deformation is relatively large in processing region 1A, 1B of metal plate 1 to be stamped by stamping portion 20.

The above-described manufacturing method for the metal component can be performed by such manufacturing apparatus 100 for the metal component. As described above, heating coil 11 is arranged to face, in the axial direction, only outer area 1A that is the area where the amount of deformation is relatively large in processing region 1A, 1B. Therefore, heating coil 11 can locally induction-heat outer area 1A that is the area where the amount of deformation is relatively large in processing region 1A, 1B of metal plate 1 to be stamped in the step of stamping metal plate 2 (S20). Thus, outer area 1A can reach a temperature higher than that of inner area 1B by short-time induction heating. As a result, according to manufacturing apparatus 100 for the metal component, it is possible to increase the productivity of metal component 4 while suppressing a break of the above-described contact area.

In above-described manufacturing apparatus 100 for the metal component, stamping is drawing. Heating coil 11 is arranged not to face, in axial direction C, the contact area coming into contact with the shoulder of pressing portion 32 in processing region 1A, 1B, but to face, in the axial direction, outer area 1A located outside the contact area.

With such a configuration, outer area 1A that is the area where the amount of deformation is relatively large in processing region 1A, 1B of metal plate 1 to be drawn can be locally induction-heated. Therefore, outer area 1A can have a temperature higher than that of inner area 1B that is the area where the amount of deformation is relatively small in processing region 1A, 1B. Thus, a break of the contact area of metal plate 1 coming into contact with the shoulder of pressing portion 32 during drawing in stamping portion 20 is suppressed. Drawing performed by above-described manufacturing apparatus 100 for the metal component is not particularly limited and includes, for example, cylindrical drawing, corner drawing and the like.

In above-described manufacturing apparatus 100 for the metal component, heating coil 11 has first coil 12, and second coil 13 connected to first coil 12 and arranged at a position closer to metal plate 1 than first coil 12 in the axial direction. An inner diameter of first coil 12 is shorter than an inner diameter of second coil 13.

In such heating coil 11, first coil 12 is arranged to face, in above-described axial direction C, the region of outer area 1A located inside. Second coil 13 is arranged to face, in above-described axial direction C, the region of outer area 1A located outside. Therefore, heating coil 11 can induction-heat metal plate 1 such that the temperature of outer area 1A of metal plate 1 becomes gradually higher from the side close to the above-described contact area toward the side distant from the above-described contact area.

Although stamping is drawing in the above-described embodiment, the present invention is not limited thereto.

Stamping may be, for example, any one of bulging, bending and burring. When stamping is bulging, an area where an amount of deformation is relatively large in a processing region of a metal plate is arranged inside an area where the amount of deformation is relatively small in the processing region. In this case as well, the area where the amount of deformation is relatively large in the processing region of the metal plate is arranged to face heating coil 11 in the above-described axial direction, and then, can be locally heated. With such a configuration, the tensile strength of the area where the amount of deformation is relatively large in the processing region of the metal plate can be reduced, and thus, the deformation resistance to stamping of the area where the amount of deformation is relatively large in the processing region of the metal plate can be sufficiently reduced. That is, the manufacturing method for the metal component according to the above-described embodiment is also suitable for bulging.

When above-described stamping is bending, an area where an amount of deformation is relatively large in a processing region of a metal plate and an area where the amount of deformation is relatively small in the processing region are arranged alternately, for example, in the above-described rolling direction. For example, an area where an amount of deformation is relatively small in a processing region is sandwiched between a first area where the amount of deformation is relatively large in the processing region and a second area spaced apart from the first area in the above-described rolling direction and having the relatively large amount of deformation in the processing region.

In this case as well, heating coil 11 is provided to be capable of simultaneously and locally heating, for example, the above-described first and second areas. Heating coil 11 is, for example, arranged below the first area and the second area to extend along a direction perpendicular to the above-described rolling direction. Each of the first and second areas where the amount of deformation is relatively large in the processing region of the metal plate is arranged to face heating coil 11 in a direction perpendicular to a lower surface of each of the first and second areas, and then, can be locally heated. With such a configuration, the tensile strength of the area where the amount of deformation is relatively large in the processing region of the metal plate can be reduced, and thus, an amount of deformation caused by spring back (phenomenon in which a workpiece after processing deforms to some extent from a shape along a shape of a die to a shape close to a shape before processing) when the die is removed after bending can be reduced. That is, the manufacturing method for the metal component according to the above-described embodiment is also suitable for bending.

When above-described stamping is burring, an area where an amount of deformation is relatively large in a burring region of a metal plate perforated with a hole in advance is arranged inside an area where the amount of deformation is relatively small in the burring region, and is arranged outside the through hole formed by the above-described perforation. In this case as well, the area where the amount of deformation is relatively large in the processing region of the metal plate is arranged to face heating coil 11 in the above-described axial direction, and then, can be locally heated. With such a configuration, the tensile strength of the area where the amount of deformation is relatively large in the processing region of the metal plate can be reduced, and thus, the occurrence of an abnormality such as a fracture in an end surface of the through hole enlarged by burring can be suppressed. The preheating conditions for burring are preferably determined in consideration of the temperature characteristic of each of the tensile strength and the elongation of the material for the workpiece. Depending on material, the elongation decreases as the heating temperature becomes higher. Therefore, the manufacturing method for the metal component according to the above-described embodiment is suitable for burring of a workpiece made of a material that is less likely to experience a decrease in elongation during heating.

Figure 12:
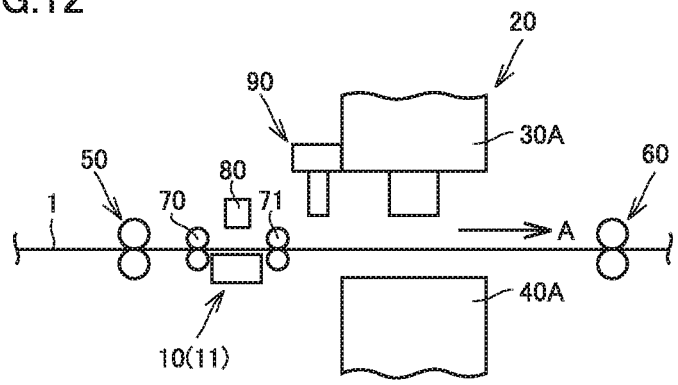
FIG. 12 shows a modification of the manufacturing apparatus for the metal component according to the present embodiment.

As shown in FIG. 12, the manufacturing apparatus for the metal component according to the above-described embodiment preferably includes a feeding portion 50 configured to supply metal plate 1 as a coil material to preheating portion 10 and stamping portion 20, and a tension applying portion 60 configured to apply tension to metal plate 1 as a coil material supplied to preheating portion 10 and stamping portion 20. Feeding portion 50 is arranged on the more upstream side than preheating portion 10 in a conveying direction (rolling direction A) of metal plate 1. Therefore, feeding portion 50 can feed metal plate 1 before application of the processing oil, and thus, an amount of feeding can be controlled with a high degree of accuracy. Tension applying portion 60 is arranged on the more downstream side than stamping portion 20 in above-described rolling direction A. Tension applying portion 60 can pull metal plate 1 subjected to shearing to the downstream side, to thereby apply tension to metal plate 1 supplied onto heating coil 11 and between punch assembly 30A and die assembly 40A.

A feeding portion and a stamping portion are generally arranged to be adjacent to each other in a conventional stamping apparatus, whereas preheating portion 10 is arranged between feeding portion 50 and stamping portion 20 in the manufacturing apparatus for the metal component according to the above-described embodiment. Therefore, a distance between feeding portion 50 and stamping portion 20 in the manufacturing apparatus for the metal component according to the above-described embodiment is longer than that in a conventional manufacturing apparatus for a metal component. Therefore, it is assumed that metal plate 1 as a coil material loosens between feeding portion 50 and stamping portion 20 in the manufacturing apparatus for the metal component according to the above-described embodiment. Accordingly, the manufacturing apparatus for the metal component according to the above-described embodiment includes tension applying portion 60, and thus, tension can be applied to metal plate 1 arranged between feeding portion 50 and tension applying portion 60 and loosening of metal plate 1 can be prevented. As a result, since the manufacturing apparatus for the metal component according to the above-described embodiment includes tension applying portion 60 in addition to feeding portion 50, metal plate 1 can be positioned with respect to preheating portion 10 and stamping portion 20 with a high degree of accuracy. Tension applying portion 60 includes, for example, a powder clutch and a motor.

As shown in FIG. 12, the manufacturing apparatus for the metal component according to the above-described embodiment preferably further includes holding portions 70 and 71 configured to maintain a distance between heating coil 11 and metal plate 1 in the vertical direction constant in preheating portion 10. Holding portion 70 is arranged on the more upstream side than heating coil 11, and holding portion 71 is arranged on the more downstream side than heating coil 11 and on the more upstream side than stamping portion 20. Thus, metal plate 1 is held at a certain distance from heating coil 11 in the above-described vertical direction during heating in the step of induction-heating metal plate 1

(S10). Therefore, an appropriate temperature distribution can be formed in metal plate 1, and the occurrence of variations among a plurality of temperature distributions formed continuously in the conveying direction in metal plate 1 is suppressed.

As shown in FIG. 12, the manufacturing apparatus for the metal component according to the above-described embodiment may further include a measuring portion 80 configured to be capable of measuring a temperature distribution of metal plate 1 immediately after metal plate 1 is induction-heated in preheating portion 10. Measuring portion 80 is, for example, a thermography camera. Preheating portion 10 may be provided to be capable of controlling the heating conditions based on the temperature distribution measured by measuring portion 80.

As shown in FIG. 12, the manufacturing apparatus for the metal component according to the above-described embodiment may further include a local cooling portion 90 configured to locally cool metal plate 1 heated locally by preheating portion 10. Local cooling portion 90 is arranged on the more downstream side than preheating portion 10 and on the more upstream side than stamping portion 20. Local cooling portion 90 can locally cool at least a part of the area (inner area 1B) where the amount of deformation is relatively small in processing region 1A, 1B. In this case, between the step of heating metal plate 1 (S10) and the step of stamping metal plate 1 (S20), the manufacturing method for the metal component according to the embodiment further includes the step of locally cooling the area where the amount of deformation is relatively small in processing region 1A, 1B.

The present inventors have confirmed that, by locally induction-heating outer area 1A of metal plate 1 made of austenitic stainless steel with heating coil 11 appropriately configured not to heat inner area 1B, outer area 1A can be heated to the temperature of approximately 100° C. and most of inner area 1B can be maintained at the temperature before heating (refer to Example 1 described below). That is, the present inventors have confirmed that the manufacturing apparatus for the metal component including preheating portion 10 appropriately configured not to heat the area where the amount of deformation is relatively small in processing region 1A, 1B does not require local cooling portion 90 shown in FIG. 12.

In addition, although the material for metal plate 1 includes austenitic stainless steel in the above-described embodiment, the present invention is not limited thereto. The material for metal plate 1 may include aluminum (Al). That is, in the manufacturing method for the metal component and the manufacturing apparatus for the metal component according to the above-described embodiment, metal plate 1 made of, for example, an aluminum alloy may be a target of processing. In this case, the temperature of heating of metal plate 1 made of an aluminum alloy by preheating portion 10 in the step of heating metal plate 1 (S10) is preferably not lower than the temperature of heating of above-described metal plate 1 including austenitic stainless steel, and more preferably a temperature exceeding the heating temperature. For example, in the above-described step (S10), metal plate 1 made of an aluminum alloy is heated to a temperature of not lower than 200° C. and not higher than 300° C. by preheating portion 10. In the manufacturing method for the metal component and the manufacturing apparatus for the metal component according to the embodiment, above-described preheating portion 10 is used, and thus, the time required for the process of preheating metal plate 1 made of an aluminum alloy is shortened, as compared with the conventional warm drawing method in which a metal plate is preheated using the die. Therefore, the time required for manufacturing one metal component made of an aluminum alloy by the manufacturing method for the metal component and the manufacturing apparatus for the metal component according to the embodiment can be shortened, as compared with that in the conventional warm drawing method.

Example

In the present example, a temperature distribution of a metal plate before stamping by the manufacturing apparatus for the metal component and the manufacturing method for the metal component according to the above-described embodiment was evaluated. A material for the metal plate was SUS316. A width of the metal plate was set at 80 mm and a thickness of the metal plate was set at 0.5 mm. A width of an inner area of the metal plate in a width direction was set at 50.5 mm and a length of the inner area in a rolling direction was set at 62 mm. Induction heating was performed under conditions that an outer area of the metal plate was heated to a temperature of not lower than 100° C. and not higher than 160° C., and the time of applying an electric current to a heating coil was set at one second. The temperature distribution of the metal plate immediately after such induction heating was evaluated using a thermography camera as well as a thermocouple and a data logger. Specifically, the temperature distribution of one processing region as a whole was evaluated using the thermography camera, and the temperature of a particular point was measured using the thermocouple and the data logger connected to a plurality of points including one point in the outer area and one point in the inner area in the processing region.

As a result of evaluation, it was confirmed that the outer area was heated to a temperature of not lower than 100° C. and not higher than 160° C., whereas the inner area was maintained at a temperature of less than 50° C., and the temperature of most of the inner area including the above-described contact area coming into contact with a shoulder of a pressing portion was not higher than 40° C., which was equal to the temperature before heating. Thus, it was confirmed that in the manufacturing apparatus for the metal component and the manufacturing method for the metal component according to the embodiment, outer area 1A could be heated to a higher temperature than inner area 1B, and the tensile strength of only austenitic stainless steel forming outer area 1A could be reduced, without reducing the tensile strength of austenitic stainless steel forming inner area 1B.

It should be understood that the embodiment disclosed herein is illustrative and non-restrictive in every respect. The scope of the present invention is defined by the terms of the claims, rather than the description above, and is intended to include any modifications within the scope and meaning equivalent to the terms of the claims.

INDUSTRIAL APPLICABILITY

The present invention is particularly advantageously applied to a manufacturing method for a metal component and a manufacturing apparatus for a metal component, in which a metal plate including austenitic stainless steel or an aluminum alloy is stamped.

REFERENCE SIGNS LIST

1, 2 metal plate; 1A, 1B processing region (1A outer area, 1B inner area); 1C first heated area; 1D second heated area;

1E third heated area; 1F non-processing region; 3*a*, 3*b*, 3*c* molded object; 4 metal component; 10 preheating portion; 11 heating coil; 12 first coil; 13 second coil; 20 stamping portion; 30A, 30B, 30C punch assembly; 31 holder; 32 pressing portion; 40, 40A, 40B, 40C die assembly; 41 base portion; 41*a*, 41*b* groove; 42 die; 42*a* inner circumferential end surface; 42*c* upper end surface; 42*d* lower end surface; 43, 45 through hole; 44 guide portion; 100 manufacturing apparatus.

The invention claimed is:

1. A manufacturing method for a metal component, the manufacturing method comprising:

locally induction-heating a metal plate by a ring-shaped heating coil; and after induction-heating the metal plate, stamping the metal plate by using a die and a punch assembly configured to press the metal plate against the die, wherein the metal plate is punched to form a blank that is then warm-drawn using the same die and punch assembly, and wherein in the induction-heating step:

a processing region of the metal plate to be stamped is arranged to face the heating coil in an axial direction of the heating coil, the processing region comprising:

an outer area where deformation during stamping is relatively large aligned with the heating coil in the axial direction, an inner area inside the outer area where deformation during stamping is relatively small aligned in the axial direction with an open area within the ring-shaped heating coil, a contact area inside the inner area which comes into contact with the punch assembly during stamping, wherein the outer area is heated to a higher temperature than the inner area such that the temperature of the outer area becomes gradually higher from a side close to the contact area toward a side distant from the contact area.

2. The manufacturing method for a metal component according to claim 1, wherein a material for the metal plate includes austenitic stainless steel or aluminum.

3. A manufacturing apparatus for a metal component, the manufacturing apparatus comprising:

a preheating portion to locally induction-heat a metal plate with a heating coil, the heating coil comprising:

a first coil with an open inner diameter, and a second coil encircling and connected to the first coil, arranged at a position to be closer to the metal plate than the first coil in an axial direction of the heating coil; and a stamping portion to stamp the metal plate, including a die and a punch assembly configured to press the metal plate against the die to form a blank and then warm draw the blank, such that the metal plate has a processing region that is included in the blank and a non-processing region outside the processing region that is not punched during stamping, wherein the axial direction of the heating coil is arranged along a movement direction of the punch assembly and the heating coil is axially aligned with an area of the processing region where deformation is relatively large during stamping, at least a part of the area where deformation is relatively large during stamping being heated to a higher temperature than an area where deformation is relatively small during stamping, and wherein the open inner diameter of the first coil of the heating coil is axially aligned with a contact area coming into contact with a shoulder and a tip surface of the punch assembly in the processing region during stamping, the heating coil being arranged at a position closer to a boundary between the processing region and the non-processing region than to the contact area.

4. The manufacturing method for a metal component according to claim 1, wherein the step of stamping the metal plate is performed without interruption after the step of induction-heating.

5. The manufacturing method for a metal component according to claim 1, wherein the temperature of the blank during the warm draw is not lower than 50° C. and not higher than 150° C.

6. A manufacturing method for a metal component, the manufacturing method comprising:

(a) locally induction-heating a metal plate using a ring-shaped induction heating coil, the metal plate having a processing region and a non-processing region outside the processing region, wherein the processing region comprises an inner area and an outer area outside the inner area, and wherein the inner area comprises a contact area;

(b) after step (a), using a die and punch assembly to punch the metal plate along a boundary defined between the processing region and the non-processing region to form a blank that includes the processing region and does not include the non-processing region; and (c) after step (b), using the die and punch assembly to warm draw the blank, wherein steps (b) and (c) are performed without interruption after step (a);

wherein, during step (a):

the inner area of the processing region aligns with an open area within the ring-shaped induction heating coil, a distance between the ring-shaped heating coil and the boundary between the processing region and the non-processing region is less than a distance between the ring-shaped heating coil and the inner area of the processing region, the outer area of the processing region aligns with a coil of the ring-shaped induction heating coil and is heated to a higher temperature than the inner area of the processing region, and at least a portion of the outer area of the processing region is heated to have a temperature that increases in a direction away from the inner area of the processing region; and wherein, during step (c): a shoulder and a tip surface of the punch assembly is in contact with the contact area of the processing region, and the outer area of the processing region is deformed by a greater amount than the inner area of the processing region.

7. The manufacturing method for a metal component according to claim 6, wherein the temperature of the blank during step (c) is not lower than 50° C. and not higher than 150° C.

* * * * *